US011761066B2

(12) United States Patent
Yang et al.

(10) Patent No.: US 11,761,066 B2
(45) Date of Patent: Sep. 19, 2023

(54) ALLOY AND A METHOD OF PREPARING THE SAME

(71) Applicant: CITY UNIVERSITY OF HONG KONG, Kowloon (HK)

(72) Inventors: Yong Yang, Kowloon (HK); Shuo Shuang, Kowloon (HK); Dukhyun Chung, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 0 days.

(21) Appl. No.: 17/359,455

(22) Filed: Jun. 25, 2021

(65) Prior Publication Data

US 2022/0018000 A1 Jan. 20, 2022

Related U.S. Application Data

(60) Provisional application No. 63/044,462, filed on Jun. 26, 2020.

(51) Int. Cl.
*C22C 30/00* (2006.01)
*C22B 9/20* (2006.01)

(52) U.S. Cl.
CPC ..... *C22C 30/00* (2013.01); *C22B 9/20* (2013.01); *C22C 2200/00* (2013.01)

(58) Field of Classification Search
None
See application file for complete search history.

(56) References Cited

U.S. PATENT DOCUMENTS

2017/0175235 A1* 6/2017 Richter ..... C22C 30/00

FOREIGN PATENT DOCUMENTS

CN 110106428 A * 8/2019 ..... C22C 1/02
CN 111321335 A * 6/2020

OTHER PUBLICATIONS

English language translation of CN-111321335-A. Generated Oct. 13, 2022. (Year: 2022).*
English language translation of CN-110106428-A. Generated Oct. 13, 2022. (Year: 2022).*

* cited by examiner

*Primary Examiner* — Brian D Walck

(57) ABSTRACT

A novel medium entropy alloy having the chemical formula $Mo_xCrNiCo$ (atomic %) where (x ranges from ~0.4 to ~1.0).

2 Claims, 9 Drawing Sheets

(a)

(b)

ALLOY AND A METHOD OF PREPARING THE SAME

CROSS-REFERENCE TO RELATED APPLICATIONS

This application claims priority to U.S. Provisional Application No. 63/044,462 filed in the United States Patent and Trademark Office on Jun. 26, 2021, entitled "ALLOY AND A METHOD OF PREPARING SAME" which is incorporated herein by reference in its entirety for all purposes.

FIELD OF INVENTION

The present invention relates alloys. In particular, the present invention relates to medium entropy alloys that possess anti-corrosion properties.

BACKGROUND OF THE INVENTION

Metal corrosion is a critical issue in a variety of industries, including oil production, mining processing and aerospace industry. In practice, corrosion not only results in degradation of material properties, leading to high costs in repairing or replacement of the corroded materials, but also leads to failure of materials in a gradual manner, hence constituting a public risk if it is not recognized.

Among the corrosion mechanisms, pitting corrosion is commonly found in different metals, which may be initiated from the damage of surface oxide layers due to the localized chemical attack of aggressive species, such as chlorides ($Cl^-$) and hydrogen ions ($H^+$). On the other hand, acidic solutions are commonly used for cleaning and processing, acid picking and oil production, with hydrochloric acid (HCl) being one of the most economical and efficient choices. Therefore, a variety of corrosion inhibitors have been developed to alleviate corrosion in metals susceptible to the chemical attack in low-pH solutions containing $Cl^-$ ions. However, most of the reported organic corrosion inhibitors are toxic, and there is a growing ecological concern about their high hazardous environmental implications. Therefore, the development of corrosion resistant alloys in low pH solutions without corrosion inhibitors is of great significance.

Accordingly, it is desirable to propose a metal alloy that has corrosion resistance that has little or no negative environmental impact.

SUMMARY OF THE INVENTION

In the first aspect, the invention proposes a medium entropy alloy (MEA) consisting of four transition metal elements, wherein the plurality of transition metal elements are arranged in a dual-phase structure; the dual phase structure comprising a face centre cubic (fcc) phase and a sigma phase.

Typically, the four transition metal elements are: molybdenum, chromium, nickel and cobalt. Preferably, the alloy has a chemical formula of $Mo_xCrNiCo$, with x=0.4 to 1.0. Advantageously, an alloy of this formula has corrosion resistance without need of additional corrosion inhibitors in the alloy.

More preferably, the sigma phase is the minority phase volumetrically and the fcc phase is the majority phase volumetrically; the signal phase forming a network around parcels of fcc phase. A network of sigma phase around a majority of fcc phase provides the possibility of corrosion resistance by the sigma phase while allowing the alloy to retain most of the advantageous physical properties of the fcc phase, such as toughness, without too much the disadvantages of the sigma such as brittleness.

Yet more preferably, the alloy has a chemical formula of $Mo_xCrNiCo$, with x=0.6.

In a second aspect, the invention proposes a method of preparing the alloy of the chemical formula $Mo_xCrNiCo$, with x=0.4 to 1.0, comprising the steps of: preparing an alloy composition by arc melting raw materials comprising four or more transition metal elements; heating the molten alloy to a temperature to precipitate a dual phase consisting of a sigma phase and an fcc phase according to the temperature and Mo range as shown in the phase diagram of FIG. 8:

Preferably, the arc melting is performed for multiple times under a Ti-gettered argon atmosphere.

More preferably, the chemical formula is $Mo_xCrNiCo$, with x=0.6, and the step of heating the molten alloy to a temperature to precipitate a dual phase consisting of a sigma phase and an fcc phase comprises heating the molten alloy to between 750 degrees Celsius and 1350 degrees Celsius; and quick quenching the molten alloy from above 750 degrees Celsius.

As shown in FIG. 8, quick quenching from 750 degrees Celsius prevents formation of miu-phase. As the skilled man knows, the miu phase is physically soft and undesirable in many applications.

Advantageously, the invention provides the possibility of a series of inhibitor-free chemically complex alloys (CCAs) with excellent corrosion resistance in low-pH solutions containing $Cl^-$ ions (e.g. HCl). Compared with traditional alloys, the anti-corrosion properties of the chemically complex alloys of the present invention do not exhibit deterioration with reducing pH (i.e. increasing $H^+$ ion concentration), or in other words, the transpassive potential of the chemically complex alloys increases with decreasing pH. These promising properties render the chemically complex alloys particularly useful in replacement of traditional alloys so as to extend service time and to reduce the risk of failure of materials in extremely corrosive environments.

BRIEF DESCRIPTION OF THE FIGURES

It will be convenient to further describe the present invention with respect to the accompanying drawings that illustrate possible arrangements of the invention, in which like integers refer to like parts. Other arrangements of the invention are possible, and consequently the particularity of the accompanying drawings is not to be understood as superseding the generality of the preceding description of the invention.

DETAILED DESCRIPTION OF SPECIFIC EMBODIMENTS

Figure 1A:
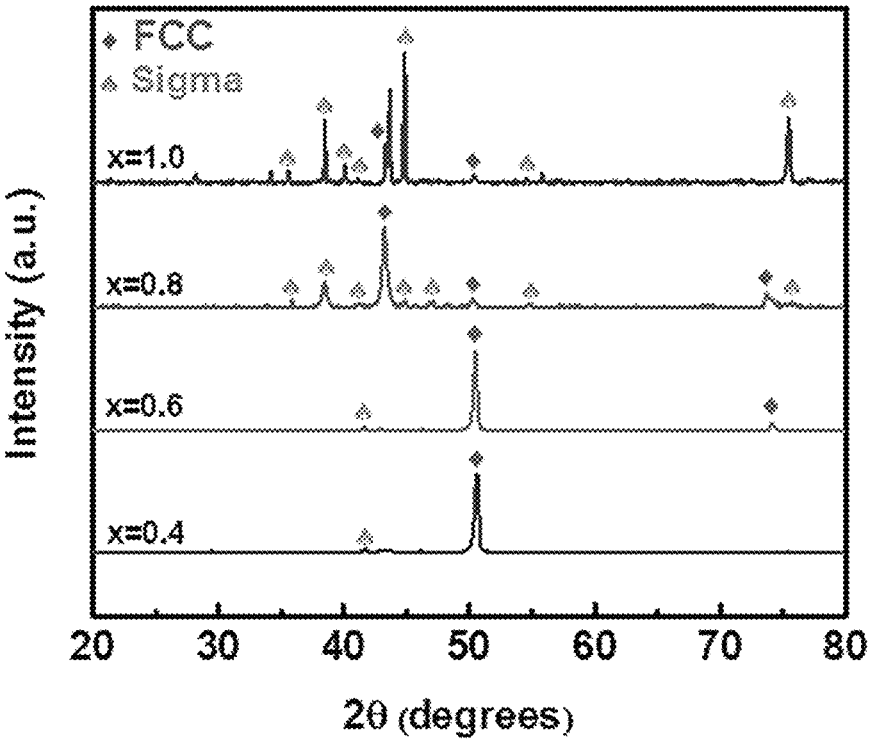
FIG. 1*a* shows the XRD patterns of an embodiment of the invention.

The present invention relates to a medium entropy, chemically complex, alloy having a dual-phase structure. In the preferred embodiment, the alloy consists of four transition metal elements molybdenum, chromium, nickel, and cobalt having the general chemical formula:

$$Mo_xCrNiCo(\text{atomic }\%) \quad (1)$$

where (x ranges from ~0.4 to ~1.0)

The meaning of medium-entropy alloys (MEAs) has to be understood in the light of the meaning of high-entropy alloys. High-entropy alloys (HEAs) is a relatively novel class of materials that are multicomponent alloys which are formed by mixing equal or relatively large proportions of usually five or more elements in near equi-molar proportions. The term "high-entropy alloys" was coined because the "entropy increase of mixing" is substantially higher when the component elements are mixed.

Entropy increase of mixing is a thermodynamic description relating to the increase in total entropy created when several separate and thermodynamically stable metals or elements are mixed together without chemical reaction into a new thermodynamic state of internal equilibrium, typically characterised at room temperature. The change in thermodynamic state can be due to differences of intermolecular forces or specific molecular effects between different elements, even though they are chemically non-reacting.

A further definition of HEA is that the gas constant R is higher than 1.5. It suffices here to point out that, as the skilled reader would know, the gas constant is often used when calculating corrosion rate of metals. An offshoot of the HEA concept is therefore medium-entropy alloys, which are alloys of usually four elements of which R is between 1 R and 1.5 R, and having non-equimolar composition. For example, a medium-entropy alloy may comprise one matrix element and several equiatomic alloying elements.

The embodiment of the chemical formula (1) above may be deemed a medium-entropy alloy. However, there are more and more research into materials classed as HEA and medium-entropy alloy, and their definition may still be evolving. Hence, the term medium entropy is used herein loosely merely for skilled reader to appreciate the advance provided by the embodiments of this invention.

The alloy of chemical formula (1) is prepared by arc melting using Mo, Cr, Ni, Co metals of high purity (99.95%) as raw materials. Typically, to ensure the chemical homogeneity, ingots of the alloy are fully re-melted at least five times in a Titanium-gettered argon atmosphere, before the melt is subsequently cast into a water-cooled Cu mould ($50\times10\times5$ $mm^3$).

The CoCrNi ternary alloy forms a single phase fcc crystal structure. However, according to the semi-empirical rules, addition of Mo into CoCrNi promotes the precipitation of sigma phase. FIG. 1 shows the XRD patterns of samples of the embodiments (hereafter denoted as Mo-x), where the peaks identifying sigma-phase are indicated.

As the skilled man knows, a sigma phase crystal is a metallic compound having a tetragonal crystalline structure, and having a typical precipitation temperature between 600 degrees Celsius and 1000 degrees Celsius. Sigma phase can increase the hardness and decrease the toughness, as well as the elongation, of the alloy. With much surprise, sigma phase in an alloy of the described chemical formula improves resistance to corrosion.

Figure 1B:
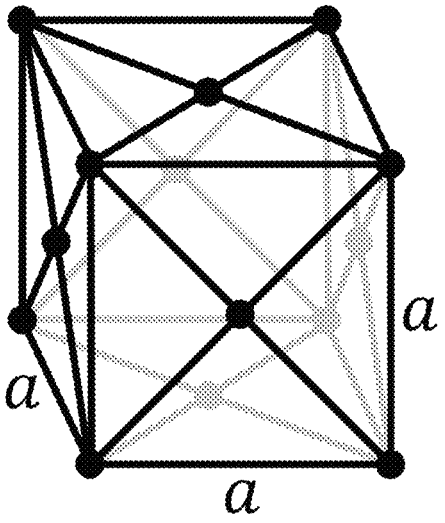
FIG. 1*b* shows an fcc crystal structure which is found in the embodiment of FIG. 1*a;*
Figure 1C:
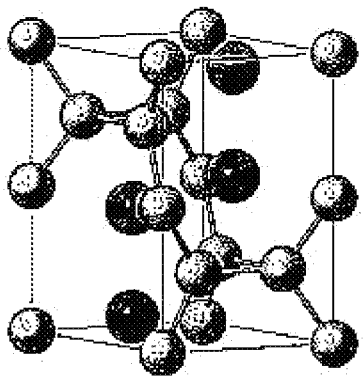
FIG. 1*c* shows a sigma phase crystal structure which is also found in the embodiment of FIG. 1*a;*

FIG. 1*b* shows a fcc crystal structure and FIG. 1*c* shows a sigma crystal structure (images taken from Wikipedia).

Figure 1D:
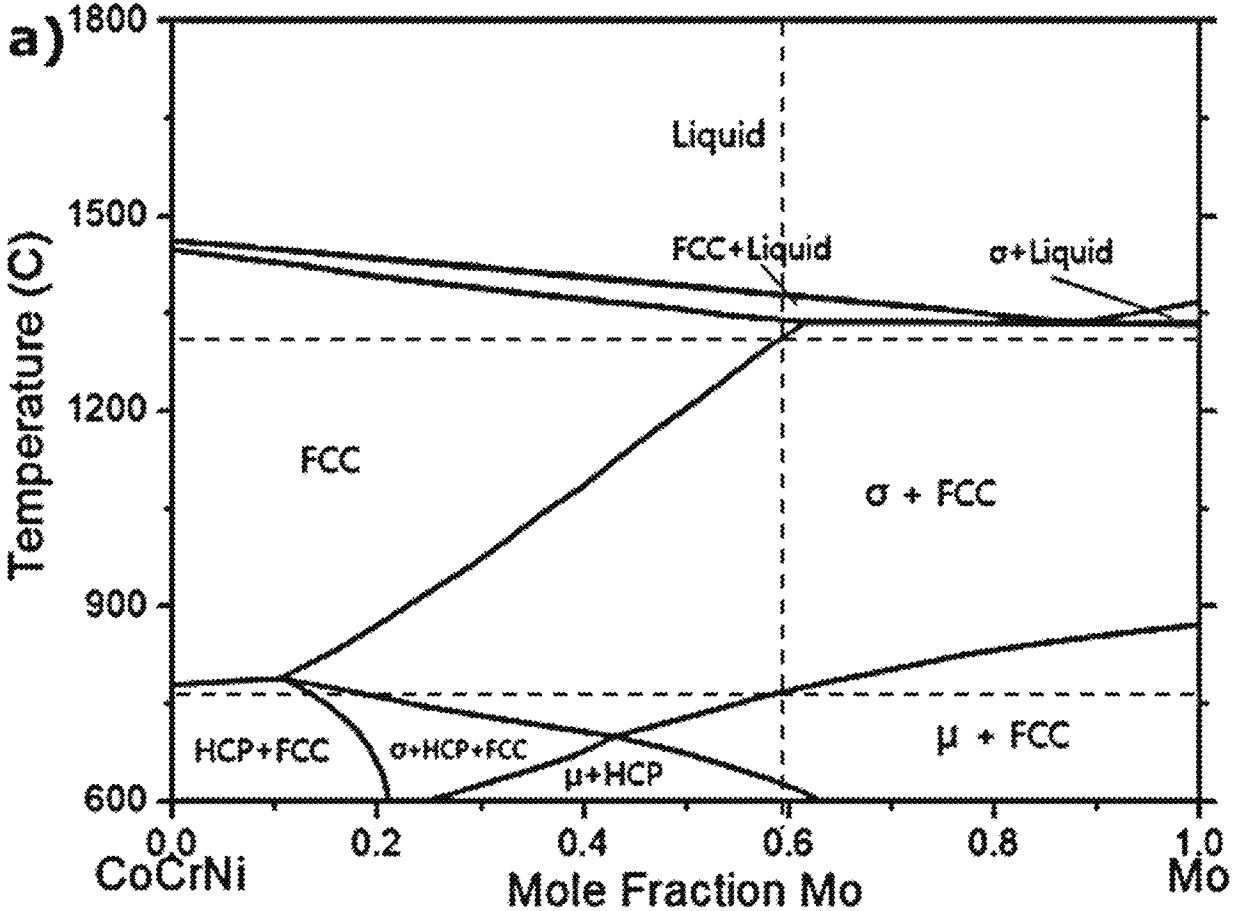
FIG. 1*d* is the phase diagram of the alloy of FIG. 1.

FIG. 1*d* is the phase diagram of the $Mo_xCrNiCo$ alloy where x=0.4 to 1.0. A dual fcc and sigma phase can be formed over a wide range of Mo, from 0.1 to 1.0. FIG. 1*d* shows how the temperature in which sigma phase may be precipitated steadily increases until Mo 0.6, after which further amounts of Mo in the alloy does not result in any increase in temperature for forming a dual phase having sigma precipitate, and the eutectic form of the alloy will begin to manifest instead.

Figure 2A:
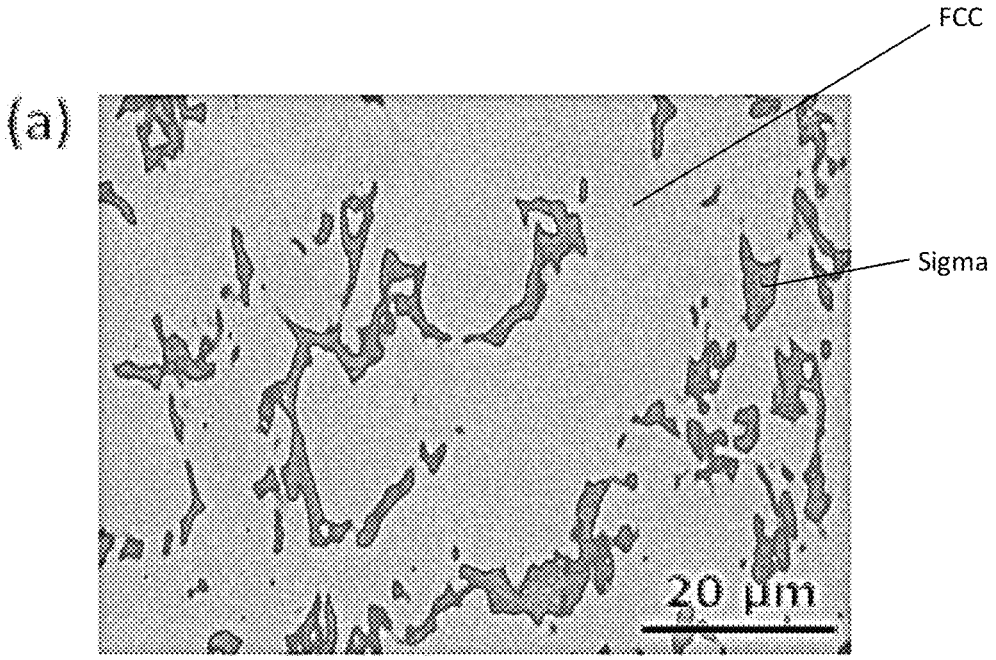
FIG. 2*a*, FIG. 2*b*, FIG. 2*c* and FIG. 2*d* shows the microstructural features of the $Mo_xCrNiCo$ alloys observed on the etched cross section, where x is 0.4 (a), 0.6 (b), 0.8 (c) or 1.0 (d).
Figure 2B:
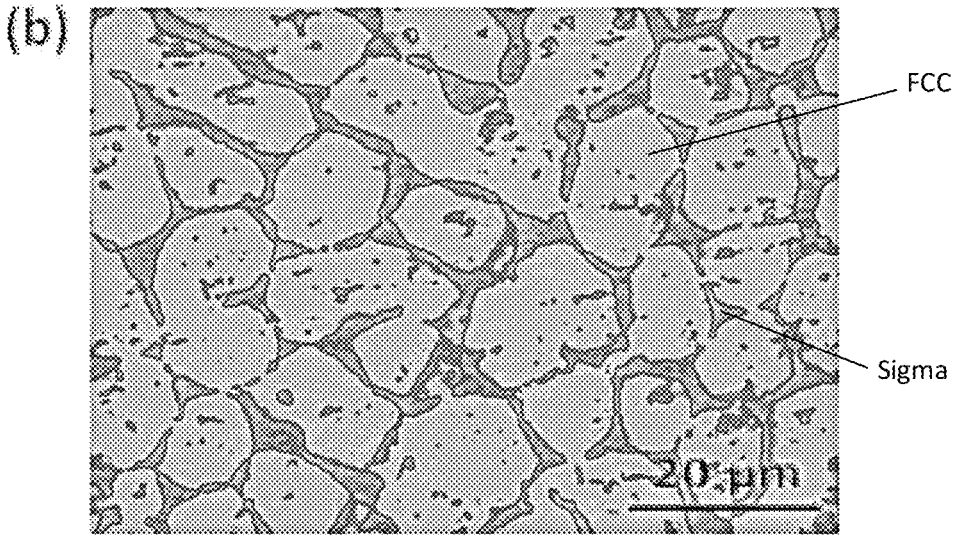
Figure 2C:
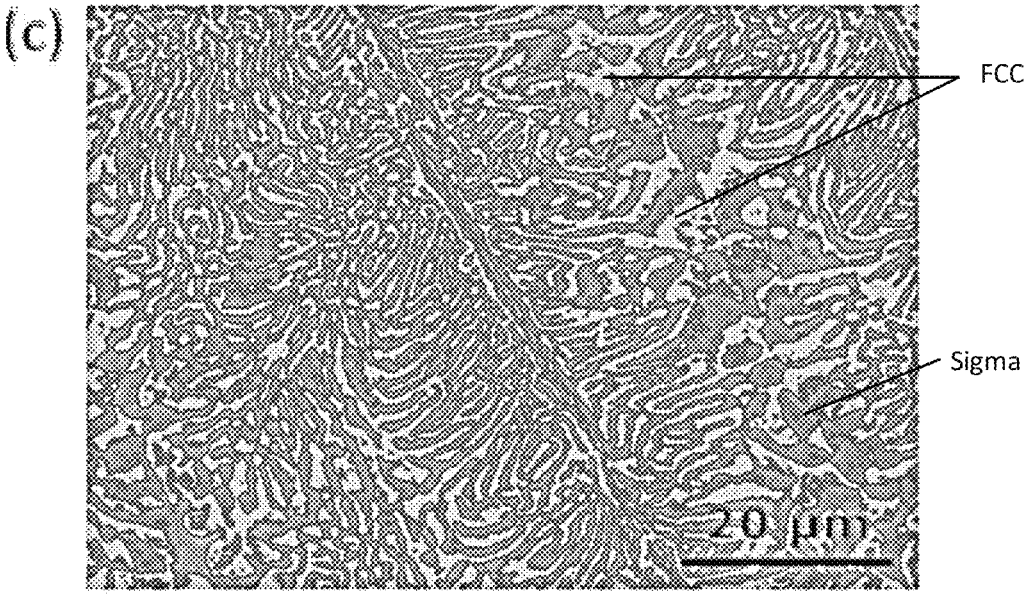
Figure 2D:
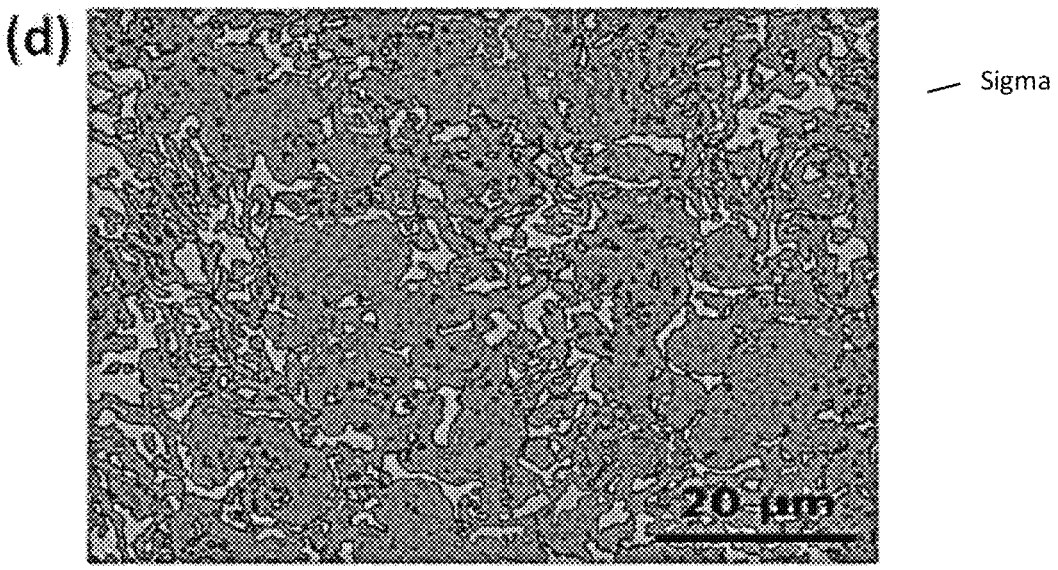

FIG. 2*a* to FIG. 2*d* show the as-cast microstructure of the CoCrNiMox alloys having different Mo content. The lighter regions are the fcc phase while the secondary, sigma phase appeared among the fcc phase. FIG. 2*a* shows the darker sigma phase scattered among the lighter fcc phase when Mo is 0.4. FIG. 2*b* shows the darker sigma phase in greater area fraction among the lighter fcc phase when Mo is 0.6. FIG. 2*c* shows that at around 0.8 Mo content, an eutectic lamellar microstructure manifests which was made up of a mixture of fcc with an average size of 10 to 20 um, and an eutectic structure with an average lamellar spacing of 800 nm. FIG. 2*d* shows that at 1.0 Mo, a fully eutectic lamellar microstructure manifests, the sigma phase becoming interconnected, displaying block shapes with an average size of 10 to 20 um.

Table 1 shows the volume fraction of the phases in different regions based on the SEM images. The fcc matrix phase in Mo-0.4 and Mo-0.6 exhibits a relatively uniform elemental distribution of Co, Cr and Ni with a low Mo content. By comparison, the eutectic regions are enriched with Mo in Mo-0.8 and Mo-1.0.

TABLE 1

| | | | Chemical Composition (%) | | | |
|---|---|---|---|---|---|---|
| Sample | Microstructure | Phase | Cr | Co | Ni | Mo |
| $Mo_{0.4}CrNiCo$ | fcc matrix with | fcc | 30.9 ± 1 | 29.8 ± 1 | 29.4 ± 1 | 9.9 ± 1 |
| | discontinuous Sigma | Sigma | 28.2 ± 1 | 45.4 ± 1 | 26.4 ± 1 | 0 |
| $Mo_{0.6}CrNiCo$ | fcc Matrix with | fcc | 29.7 ± 2 | 29.2 ± 2 | 28.9 ± 2 | 12.2 ± 2 |
| | network of sigma | Sigma | 30.1 ± 2 | 27.6 ± 2 | 26.7 ± 2 | 15.6 ± 2 |

TABLE 1-continued

| Sample | Microstructure | Phase | Chemical Composition (%) Cr | Co | Ni | Mo |
|---|---|---|---|---|---|---|
| $Mo_{0.8}CrNiCo$ | Fully eutectic | Eutectic fcc | 25.0 ± 1 | 28.2 ± 1 | 31.6 ± 1 | 15.2 ± 1 |
| | | Eutectic Sigma | 28.1 ± 1 | 24.1 ± 1 | 18.9 ± 1 | 27.9 ± 1 |
| $Mo_{1.0}CrNiCo$ | Mixture of eutectic and Sigma | Sigma | 27.2 ± 2 | 24.5 ± 2 | 18.6 ± 2 | 29.7 ± 2 |
| | | Eutectic fcc | 23.8 ± 1 | 28.0 ± 1 | 32.7 ± 1 | 15.5 ± 1 |
| | | Eutectic Sigma | 27.1 ± 1 | 23.7 ± 1 | 20.2 ± 1 | 29.0 ± 1 |

Figure 4:
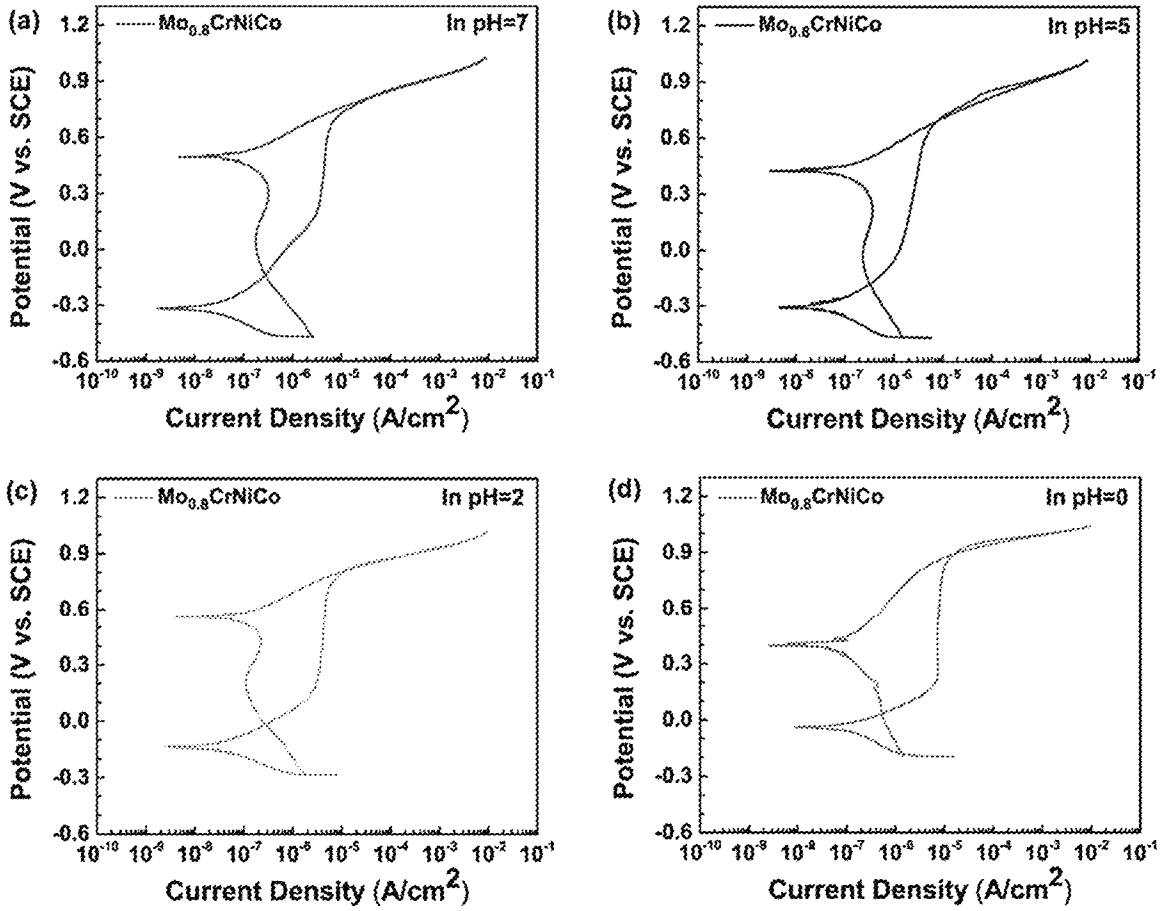
FIG. 4 shows the cyclic potentiodynamic polarization curves of $Mo_{0.8}CrNiCo$ in 1 M Cl-containing solution with different pH values of 7 (a), 5 (b), 2 (c) or 0 (d).

FIG. 4 shows the cyclic potentiodynamic polarization curves of $Mo_{0.8}CrNiCo$ in 1 M $Cl^-$ containing solution with different pH values of 7 (a), 5 (b), 2 (c) or 0 (d).

Figure 5A:
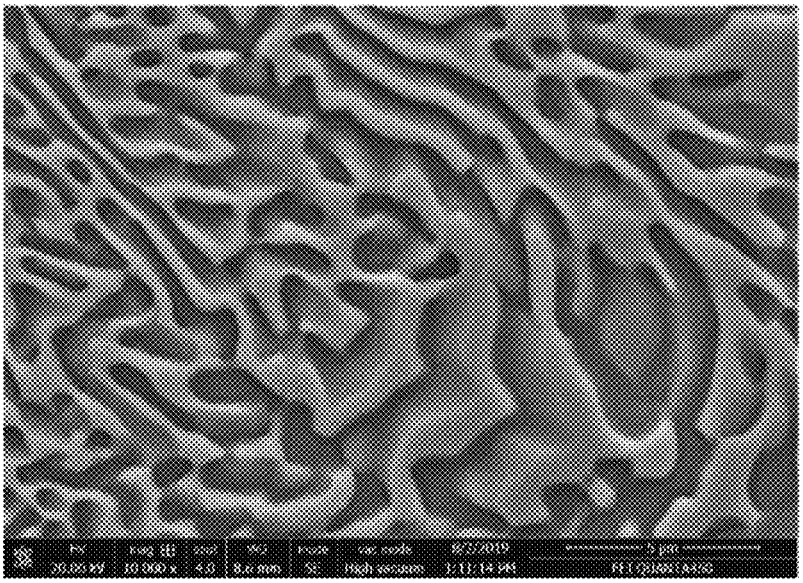
FIGS. 5(*a*) and 5(*b*) shows the corrosion morphologies of $Mo_{0.8}CrNiCo$ after cyclic potentiodynamic polarization tests in 1 M $Cl^-$ containing solution with different pH values of 7 (FIG. 5(*a*)) and 0 (FIG. 5(*b*)).
Figure 5B:
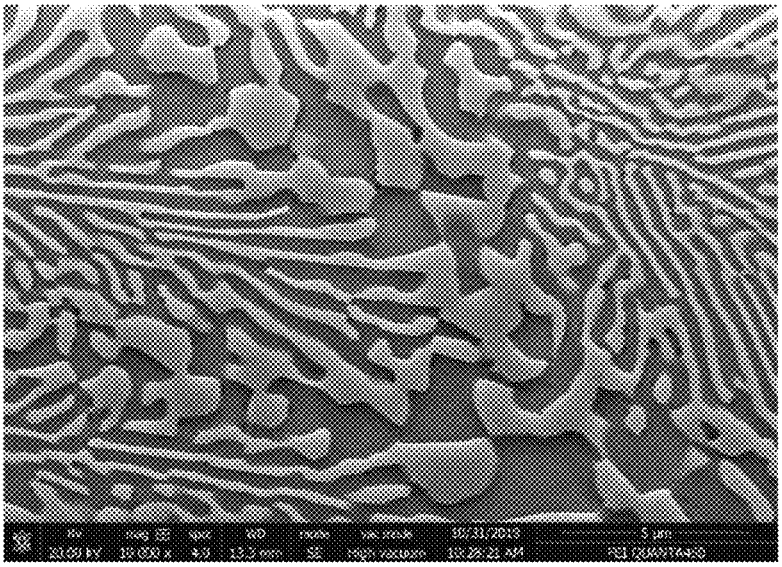

FIGS. 5(*a*) and 5(*b*) shows the corrosion morphologies of $Mo_{0.8}CrNiCo$ after cyclic potentiodynamic polarization tests in 1 M $Cl^-$ containing solution with different pH values of 7 (FIG. 5(*a*)) and 0 (FIG. 5(*b*)).

Figure 6:
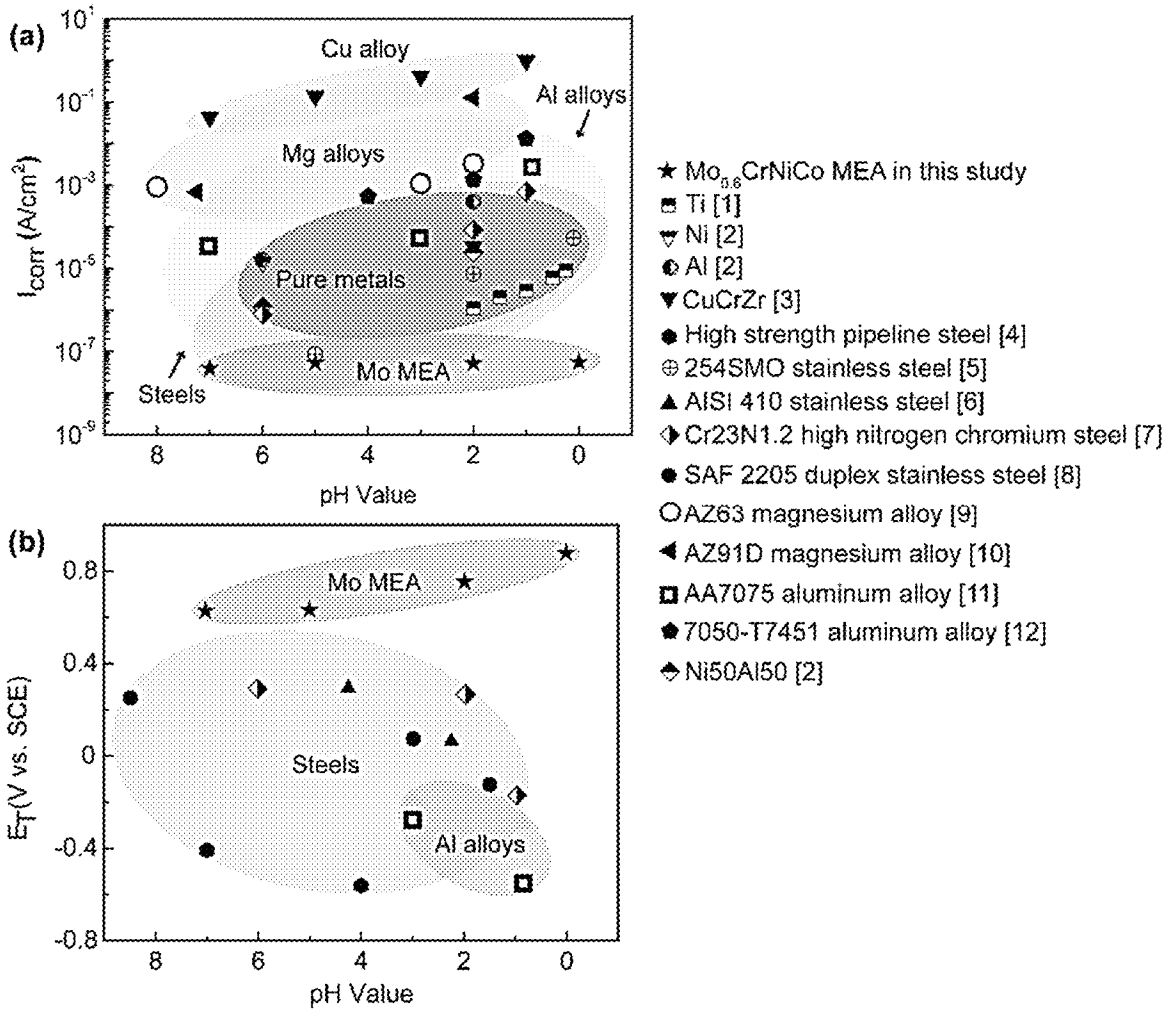
FIG. 6 shows the comparison of the corrosion current density ($i_{corr}$) and transpassivation potential ($E_T$) between MEAs and other materials in Cl-containing solution with reducing pH at room temperature.
Figure 7:
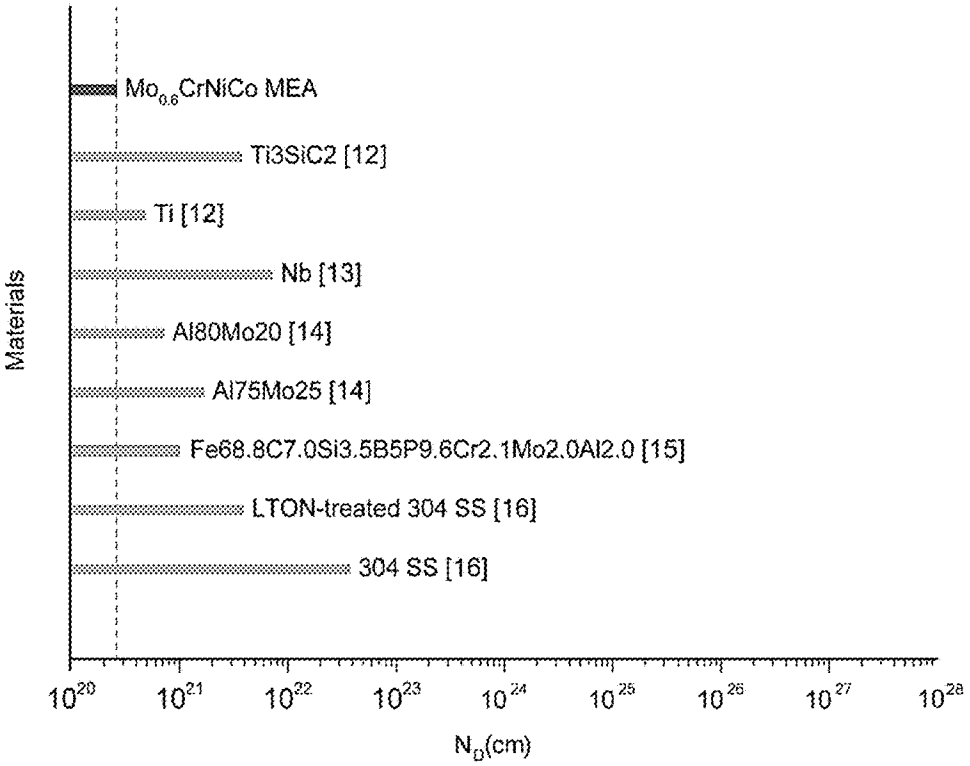
FIG. 7 shows comparison of point defect density of MEA and reported other metal and alloys in 1M HCl solution.
Figure 8:
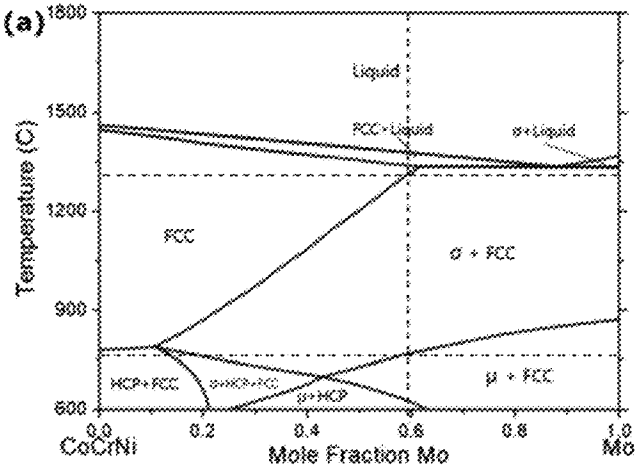
FIG. 8 shows a phase diagram of a method of preparing an alloy according to the disclosure.

FIG. 6 shows the comparison of the corrosion current density ($i_{corr}$) and transpassivation potential ($E_T$) between medium-entropy alloys and other materials in $Cl^-$ containing solution with reducing pH at room temperature. It can be seen that the alloys of chemical formula (1) has lower corrosion current than Mg alloys, Al alloys pure metals and is as good as still even at the lower pH.

Figure 3:
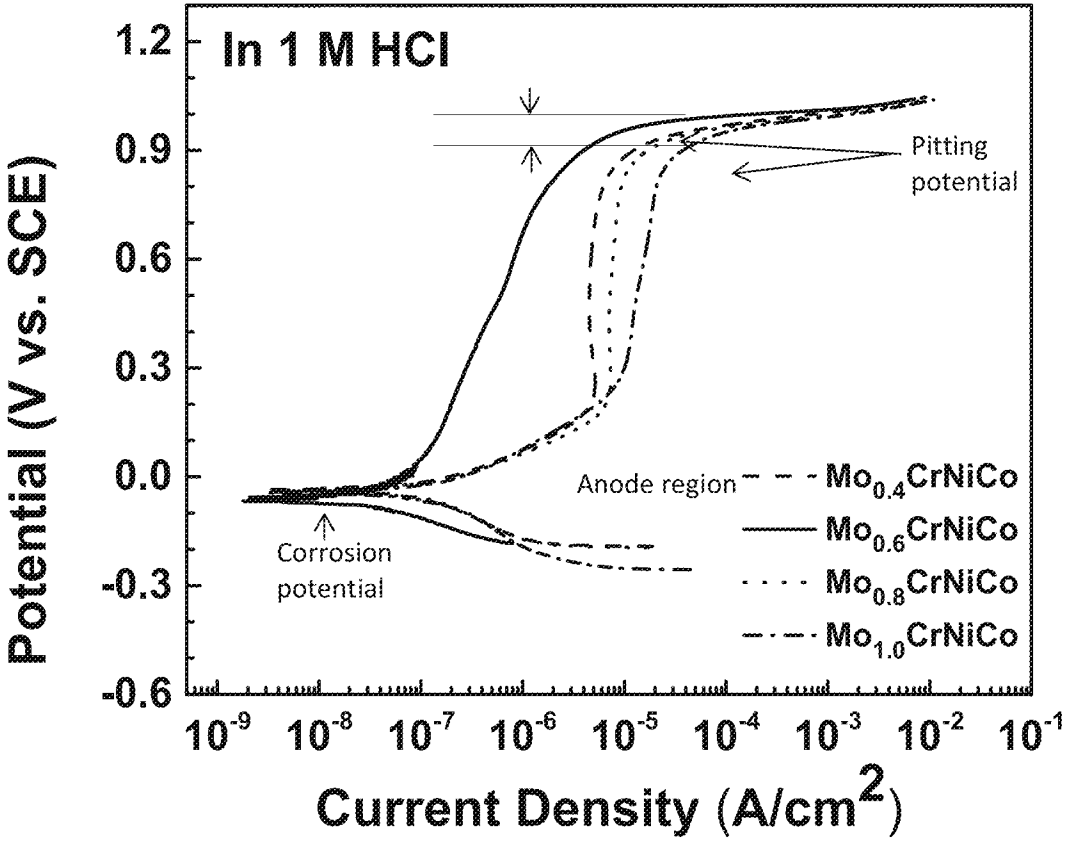
FIG. 3 shows the potentiodynamic polarization curves of MoCrNiCo alloys in 1 M HCl solution.

Table 2 shows the electrochemical parameters of MoCrNiCo alloys in 1 M HCl solution obtained from the potentiodynamic polarization curves of FIG. 3.

TABLE 2

| Samples | $E_{corr}$ ($mV_{SCE}$) | $I_{corr}$ ($A \cdot cm^{-2}$) | $E_T$ ($mV_{SCE}$) |
|---|---|---|---|
| $Mo_{0.4}CrNiCo$ | −49 | $10.72 \times 10^{-8}$ | 852 |
| $Mo_{0.6}CrNiCo$ | −76 | $4.12 \times 10^{-8}$ | 889 |
| $Mo_{0.8}CrNiCo$ | −44 | $7.96 \times 10^{-8}$ | 879 |
| $Mo_{1.0}CrNiCo$ | −57 | $13.20 \times 10^{-8}$ | 866 |

Table 3 which shows the electrochemical parameters of $Mo_{0.8}CrNiCo$ alloys obtained from the cyclic potentiodynamic polarization curves of FIG. 4.

TABLE 3

| Samples | Solution | $E_{corr}$ ($mV_{SCE}$) | $I_{corr}$ ($A \cdot cm^{-2}$) | $E_T$ ($mV_{SCE}$) |
|---|---|---|---|---|
| $Mo_{0.8}CrNiCo$ | Pure NaCl (pH = 7) | −365 | $2.63 \times 10^{-8}$ | 612 |
| $Mo_{0.8}CrNiCo$ | NaCl + HCl (pH = 5) | −304 | $4.57 \times 10^{-8}$ | 640 |
| $Mo_{0.8}CrNiCo$ | NaCl + HCl (pH = 2) | −148 | $4.58 \times 10^{-8}$ | 753 |
| $Mo_{0.8}CrNiCo$ | Pure HCl (pH = 0) | −44 | $7.96 \times 10^{-8}$ | 879 |

Table 4 shows the summary of electrochemical parameters of reported other metal and alloys in $Cl^-$ containing solution with reducing pH.

TABLE 4

| Material | pH value | $I_{corr}$ ($A/cm^2$) | $E_b$ ($mV_{SCE}$) |
|---|---|---|---|
| Ti | 2 | $1.1 \times 10^{-6}$ | — |
| | 1.5 | $2.0 \times 10^{-6}$ | — |
| | 1 | $2.9 \times 10^{-6}$ | — |

TABLE 4-continued

| Material | pH value | $I_{corr}$ ($A/cm^2$) | $E_b$ ($mV_{SCE}$) |
|---|---|---|---|
| | 0.5 | $6.0 \times 10^{-6}$ | — |
| | 0.25 | $9.0 \times 10^{-6}$ | — |
| Ni | 6 | $1.4 \times 10^{-5}$ | — |
| | 2 | $3.4 \times 10^{-5}$ | — |
| Al | 6 | $1.6 \times 10^{-5}$ | — |
| | 2 | $4.0 \times 10^{-5}$ | — |
| CuCrZr | 7 | $4.3 \times 10^{-2}$ | — |
| | 5 | $1.4 \times 10^{-1}$ | — |
| | 3 | $4.2 \times 10^{-1}$ | — |
| | 1 | 2.0 | — |
| high strength | 7 | $2.6 \times 10^{-5}$ | −409 |
| pipeline steel | 4 | $1.9 \times 10^{-5}$ | −562 |
| 254SMO | 5 | $8.6 \times 10^{-7}$ | 920 |
| stainless steel | 2 | $7.3 \times 10^{-6}$ | 719 |
| | 0.1 | $5.4 \times 10^{-5}$ | 892 |
| AISl 410 | 4.25 | — | 295 |
| stainless steel | 2.25 | — | 65 |
| Cr23N1.2 | 6 | $7.9 \times 10^{-7}$ | 278 |
| high nitrogen | 2 | $8.5 \times 10^{-5}$ | 276 |
| chromium steel | 1 | $7.0 \times 10^{-4}$ | −181 |
| SAF 2205 | 8.5 | — | 252 |
| DSS | 3 | — | 72 |
| | 1.5 | — | −124 |
| AZ63 | 8 | $9.2 \times 10^{-4}$ | — |
| magnesium alloy | 3 | $1.1 \times 10^{-3}$ | — |
| | 2 | $3.3 \times 10^{-3}$ | — |
| AZ91D | 7.25 | $6.6 \times 10^{-4}$ | — |
| Magnesium alloy | 2 | $1.3 \times 10^{-1}$ | — |
| AA7075 | 7 | $3.4 \times 10^{-5}$ | −600 |
| aluminum alloy | 3 | $5.1 \times 10^{-5}$ | −278 |
| | 0.85 | $2.0 \times 10^{-3}$ | −552 |
| 7050-T7451 | 4 | $5.3 \times 10^{-4}$ | — |
| aluminum alloy | 2 | $1.3 \times 10^{-3}$ | — |
| | 1 | $1.3 \times 10^{-2}$ | — |
| Ni50Al50 | 6 | $1.2 \times 10^{-6}$ | — |
| | 2 | $2.4 \times 10^{-5}$ | — |

Table 5 shows the summary of point defect density of medium-entropy alloy and reported other metal and alloys in 1M HCl solution.

TABLE 5

| Materials | Point defect density/$cm^3$ |
|---|---|
| $Mo_{0.6}CrNiCo$ | $2.63 \times 10^{20}$ |
| $Ti_3SiC_2$ | $3.80 \times 10^{21}$ |
| Ti | $4.85 \times 10^{20}$ |
| Nb | $7.42 \times 10^{21}$ |
| $Al_{80}Mo_{20}$ | $7.20 \times 10^{20}$ |
| $Al_{75}Mo_{25}$ | $1.70 \times 10^{21}$ |
| $Fe_{68.8}C_{7.0}Si_{3.5}$—$B_5P_{9.6}Cr_{2.1}Mo_{2.0}Al_{2.0}$ | $9.95 \times 10^{20}$ |
| LTON-treated 304 SS | $3.89 \times 10^{21}$ |
| 304 SS | $3.78 \times 10^{22}$ |

Accordingly, an alloy of chemical formula (1) provides a unique dual-phase structures and high entropy passive film effectively prevents severe pitting corrosion, leading to more general corrosion. It is found that all chemically complex alloys of chemical formula (1) exhibit a low corrosion rate, and good passivation as well as repassivation ability in HCl. The anti-corrosion ability was determined to be substantially unchanged with decreasing pH. Moreover, the transpassivation potential of the chemically complex alloys chemical formula (1) shows an increase with reducing pH. Such promising anti-corrosion ability may be attributed to the formation of protective passive oxide film and the dual-phase structure of the chemically complex alloys, which prevent severe pitting corrosion within the chemically complex alloys' structure.

In particular, the alloy having a chemical formula of $Mo_{0.8}CrNiCo$ was found to be the most corrosion resistant, illustrated poignantly in FIG. 3 where $Mo_{0.8}CrNiCo$ has high pitting potential than the alloys with other Mo content.

Accordingly, the configuration of the dual-phase alloy of FIG. 2*b* is the preferred embodiment. The sigma phase forms a network around larger pockets of fcc phase. This provides protection of the $Mo_{0.8}CrNiCo$ alloy from corrosion and, possibly, imparts superior hardness by the sigma phase network while allowing the alloy to retain the properties of the fcc phase. The dual phase $Mo_{0.8}CrNiCo$ alloy can be formed between 750 degrees Celsius to 1350 degrees Celsius, and quick quenched in water when the alloy is above 750 degree Celsius to avoid the formation of miu (p) phase.

While there has been described in the foregoing description preferred embodiments of the present invention, it will be understood by those skilled in the technology concerned that many variations or modifications in details of design, construction or operation may be made without departing from the scope of the present invention as claimed.

The invention claimed is:

1. An alloy of $Mo_{0.6}CrNiCo$ characterized in having a dual phase consisting of a face centered cubic (fcc) phase and a sigma phase, wherein the sigma phase is the minority phase volumetrically and the fcc phase is the majority phase volumetrically; and the sigma phase forms a network around parcels of the fcc phase.

2. A method of preparing the alloy of claim 1, comprising:

arc melting molybdenum, chromium, nickel, and cobalt into a molten alloy;

heating the molten alloy to a temperature between 750 degrees Celsius and 1350 degrees Celsius to precipitate the dual phase; and quick quenching the molten alloy from above 750 degrees Celsius.

* * * * *